US009402293B2

(12) United States Patent
Vaughan et al.

(10) Patent No.: US 9,402,293 B2
(45) Date of Patent: Jul. 26, 2016

(54) MULTI-BLEEDER MODE CONTROL FOR IMPROVED LED DRIVER PERFORMANCE

(71) Applicant: Power Integrations, Inc., San Jose, CA (US)

(72) Inventors: Peter Vaughan, Los Gatos, CA (US); Ricardo L. J. Pregitzer, Campbell, CA (US)

(73) Assignee: Power Integrations, Inc., San Jose, CA (US)

( * ) Notice: Subject to any disclaimer, the term of this patent is extended or adjusted under 35 U.S.C. 154(b) by 186 days.

(21) Appl. No.: 14/261,271

(22) Filed: Apr. 24, 2014

(65) Prior Publication Data

US 2015/0312978 A1 Oct. 29, 2015

(51) Int. Cl.
*H05B 33/08* (2006.01)
*H05B 37/02* (2006.01)

(52) U.S. Cl.
CPC ..... *H05B 33/089* (2013.01); *H05B 33/0815* (2013.01); *H05B 33/0845* (2013.01); *H05B 37/02* (2013.01)

(58) Field of Classification Search
None
See application file for complete search history.

(56) References Cited

U.S. PATENT DOCUMENTS 8,174,204 B2 * 5/2012 Melanson ..... H05B 33/0815 315/224
8,937,435 B1 * 1/2015 Sutardja ..... H05B 33/0815 315/219
9,214,851 B1 * 12/2015 Mao ..... H02M 1/08
2005/0122171 A1 * 6/2005 Miki ..... H03G 1/0088 330/285
2008/0048573 A1 * 2/2008 Ferentz ..... H05B 33/0815 315/193
2008/0224629 A1 * 9/2008 Melanson ..... H05B 33/0815 315/247
2010/0164406 A1 * 7/2010 Kost ..... H05B 33/0815 315/307
2011/0068706 A1 * 3/2011 Otake ..... H05B 33/0815 315/291
2012/0126714 A1 * 5/2012 Deppe ..... H05B 33/0815 315/192
2012/0181946 A1 * 7/2012 Melanson ..... H03K 17/18 315/247
2012/0242238 A1 * 9/2012 Chen ..... H05B 33/0815 315/200 R
2012/0262087 A1 * 10/2012 Watanabe ..... H05B 33/0815 315/291
2012/0286663 A1 * 11/2012 Puvanakijjakorn H05B 33/0845 315/85
2012/0286686 A1 * 11/2012 Watanabe ..... H05B 33/0815 315/224
2013/0009616 A1 * 1/2013 Chang ..... H05B 33/0806 323/241
2013/0278159 A1 * 10/2013 Del Carmen, Jr. . H05B 33/0809 315/200 R (Continued)

FOREIGN PATENT DOCUMENTS

EP 2076095 A2 7/2009
EP 2373124 A1 10/2011
WO WO 2013/114234 A1 8/2013

OTHER PUBLICATIONS

European Patent Application No. 15164422.6—European Search Report, mailed Nov. 10, 2015, 5 pages.

(Continued)

*Primary Examiner* — Crystal L Hammond
(74) *Attorney, Agent, or Firm* — Blakely Sokoloff Taylor & Zafman LLP

(57) ABSTRACT

Various examples directed to phase-dimming LED driver input circuitry having multiple bleeder circuits activated by a controller with multi-bleeder mode control are disclosed. In one example, the input circuitry may include multiple bleeder circuits controlled by the controller in an open-loop or closed-loop configuration. The controller may selectively activate or deactivate the multiple bleeder circuits based on the input line voltage, the dimming state, and the type of dimming being implemented to improve performance of the LED driver by preventing or reducing shimmering/blinking and by reducing bleeder loss.

23 Claims, 5 Drawing Sheets

(56) References Cited

U.S. PATENT DOCUMENTS

2013/0342122 A1* 12/2013 Sawada ..... H03K 17/51 315/200 R
2013/0343090 A1* 12/2013 Eom ..... H02M 3/33507 363/16
2014/0009973 A1* 1/2014 Eom ..... H02M 3/33507 363/21.12
2014/0015432 A1* 1/2014 Otake ..... H02M 1/4208 315/206
2014/0063857 A1* 3/2014 Peng ..... H05B 33/0815 363/16
2014/0265888 A1* 9/2014 Ekbote ..... H05B 33/0809 315/186
2014/0333228 A1* 11/2014 Angeles ..... H05B 33/0815 315/291
2015/0077004 A1* 3/2015 Jiang ..... H05B 37/029 315/201
2015/0319818 A1* 11/2015 Kahlman ..... H05B 37/0209 315/201

OTHER PUBLICATIONS

European Patent Application No. 15164422.6—European Office Action, mailed Nov. 26, 2015, 6 pages.
AN10754 Application Note: "SSL2101 and SSL2102 dimmable mains LED driver", NXP Semiconductors, Rev. Oct. 3-16, 2009,© NXP B.V. 2009, pp. 1-36.

* cited by examiner

MULTI-BLEEDER MODE CONTROL FOR IMPROVED LED DRIVER PERFORMANCE

BACKGROUND

1. Field

The present disclosure relates generally to circuits for driving light-emitting diodes (LEDs) and, more specifically, to LED driver circuits having phase-angle dimming circuitry.

2. Related Art

LED lighting has become popular in the industry due to the many advantages that this technology provides. For example, LED lamps typically have a longer lifespan, pose fewer hazards, and provide increased visual appeal when compared to other lighting technologies, such as compact fluorescent lamp (CFL) or incandescent lighting technologies. The advantages provided by LED lighting have resulted in LEDs being incorporated into a variety of lighting technologies, televisions, monitors, and other applications.

It is often desirable to implement LED lamps with a dimming functionality to provide variable light output. One known technique that has been used for analog LED dimming is phase-angle dimming, which may be implemented using either leading-edge or trailing-edge phase-control. A Triac circuit is often used to perform this type of phase-angle dimming and operates by delaying the beginning of each half-cycle of alternating current (ac) power or trimming the end of each half-cycle of ac power. By delaying the beginning of each half-cycle or trimming the end of each half-cycle, the amount of power delivered to the load (e.g., the lamp) is reduced, thereby producing a dimming effect in the light output by the lamp. In most applications, the delay in the beginning of each half-cycle or trimming of the end of each half-cycle is not noticeable because the resulting variations in the phase-controlled line voltage and power delivered to the lamp occur more quickly than can be perceived by the human eye. For example, Triac dimming circuits work especially well when used to dim incandescent light bulbs since the variations in phase-angle with altered ac line voltages are immaterial to these types of bulbs. However, flicker may be noticed when Triac circuits are used for dimming LED lamps.

Flickering in LED lamps can occur because these devices are typically driven by LED drivers having regulated power supplies that provide regulated current and voltage to the LED lamps from ac power lines. Unless the regulated power supplies that drive the LED lamps are designed to recognize and respond to the voltage signals from Triac dimming circuits in a desirable way, the Triac dimming circuits are likely to produce non-ideal results, such as limited dimming range, flickering, blinking, and/or color shifting in the LED lamps.

The difficulty in using Triac dimming circuits with LED lamps is in part due to a characteristic of the Triac itself. Specifically, a Triac is a semiconductor component that behaves as a controlled ac switch. Thus, the Triac behaves as an open switch to an ac voltage until it receives a trigger signal at a control terminal, causing the switch to close. The switch remains closed as long as the current through the switch is above a value referred to as the "holding current." Most incandescent lamps draw more than the minimum holding current from the ac power source to enable reliable and consistent operation of a Triac. However, the comparably low currents drawn by LEDs from efficient power supplies may not meet the minimum holding currents required to keep the Triac switches conducting for reliable operation. As a result, the Triac may trigger inconsistently. In addition, due to the inrush current charging the input capacitance and because of the relatively large impedance that the LEDs present to the input line, a significant ringing may occur whenever the Triac turns on. This ringing may cause even more undesirable behavior as the Triac current may fall to zero and turn off the LED load, resulting in a flickering effect.

To address these issues, conventional LED driver designs typically rely on current drawn by a dummy load or "bleeder circuit" of the power converter to supplement the current drawn by the LEDs in order to draw a sufficient amount of current to keep the Triac conducting reliably after it is triggered. These bleeder circuits may typically include passive components and/or active components controlled by a controller or by the converter parameters in response to the load level. While useful to sink additional current, a bleeder circuit that is external to the integrated circuit requires the use of extra components with associated penalties in cost and efficiency.

BRIEF DESCRIPTION OF THE DRAWINGS

Non-limiting and non-exhaustive embodiments are described with reference to the following figures, wherein like reference numerals refer to like parts throughout the various views unless otherwise specified.

DETAILED DESCRIPTION

In the following description, numerous specific details are set forth in order to provide a thorough understanding. It will be apparent, however, to one having ordinary skill in the art that the specific details need not be employed.

Various examples directed to phase-dimming LED driver input circuitry having multiple bleeder circuits activated by a controller with multi-bleeder mode control are disclosed. In one example, the input circuitry may include multiple bleeder circuits controlled by the controller in an open-loop or closed-loop configuration. The controller may selectively activate or deactivate the multiple bleeder circuits based on the input line voltage, the dimming state, and the type of dimming being implemented to improve performance of the LED driver by preventing or reducing shimmering/blinking and by reducing bleeder loss.

Figure 1:
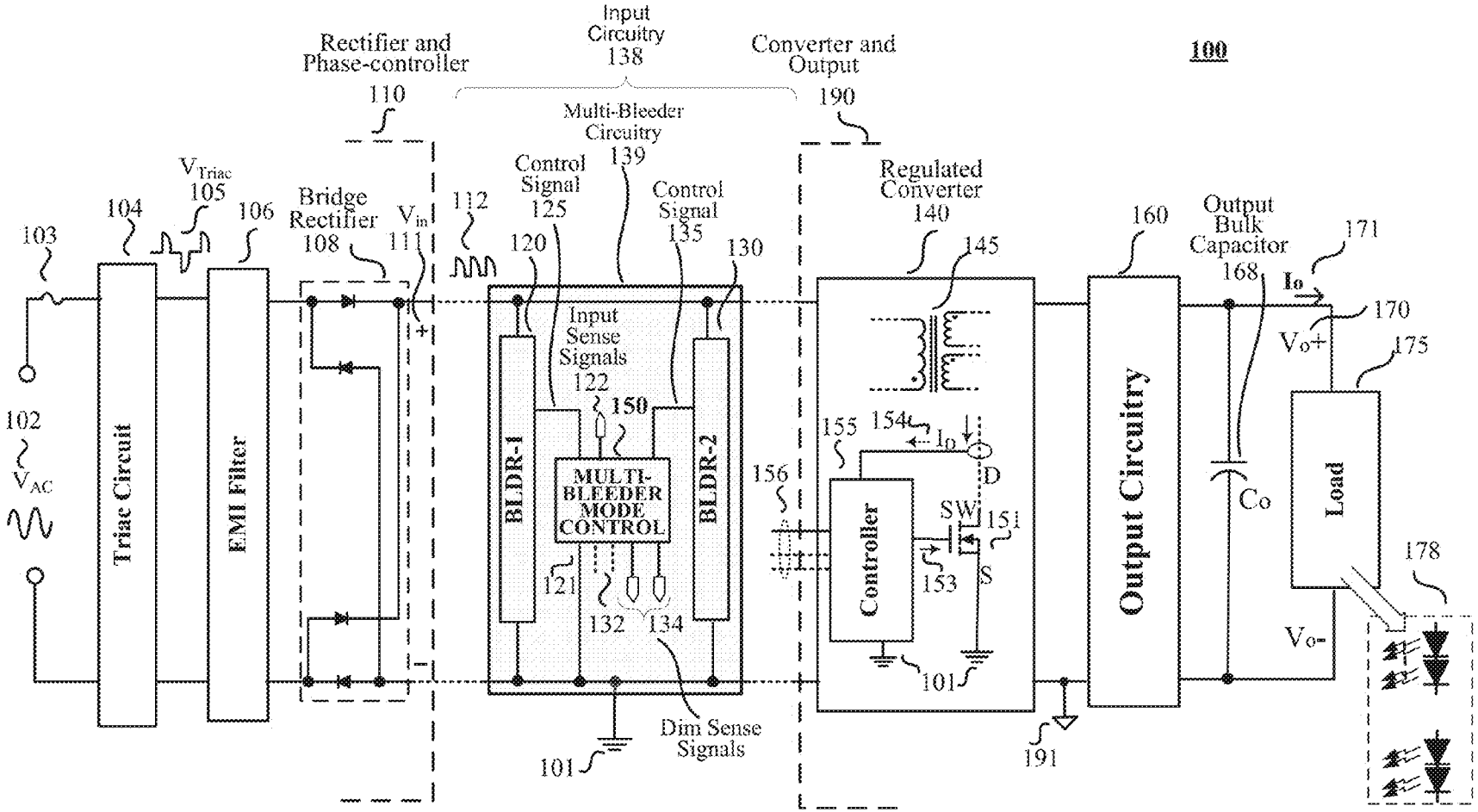
FIG. 1 shows a general block diagram of an offline LED driver system having a Triac phase control dimmer according to various examples.

FIG. 1 shows a general block diagram of an example LED driver system 100 including a regulated converter 140 and a pre-stage Triac dimming circuit 104. As shown, Triac dimming circuit 104 is coupled to receive an input ac line signal $V_{AC}$ 102 from the input terminals of LED driver system 100 through a fusible protection device 103. Triac dimming circuit 104 may apply leading-edge phase control by delaying the beginning of each half-cycle of input ac line signal $V_{AC}$ 102 or may apply trailing-edge phase control by trimming the end of each half-cycle of input ac line signal $V_{AC}$ 102 to produce a phase-controlled ac line/input signal or a phase-controlled Triac signal $V_{Triac}$ 105. By removing a portion of each half-cycle of the input ac line signal $V_{AC}$ 102 using Triac dimming circuit 104, the amount of power delivered to the load 175 (e.g., a lamp or LED array 178) is reduced and the light output by the LED appears dimmed.

LED driver system 100 may further include bridge rectifier 108 coupled to receive the phase-controlled Triac signal $V_{Triac}$ 105 through the electromagnetic interference (EMI) filter 106. As shown in the depicted example, the phase-controlled rectified input voltage $V_{in}$ 111 (represented by symbolic waveform 112) output by the bridge rectifier 108 has a conduction phase-angle in each half line cycle that is controlled by Triac dimming circuit 104. The phase-controlled rectified input voltage $V_{in}$ 111 provides an adjustable average dc voltage to a high frequency regulated converter 140 through input circuitry 138 that, in one example, may include interface devices/blocks, such as input sense/detect circuitry, an inductive and capacitive filter, a damper, and one or more passive/active bleeders with closed-loop or open-loop control depending on the application.

As illustrated in FIG. 1, input circuitry 138 may be coupled between the rectifier and phase-controller portion 110 and the converter and output portion 190 of LED driver system 100. In the example shown in FIG. 1, input circuitry 138 includes multiple-bleeder circuitry 139, which may include multiple bleeder circuits, such as bleeder circuits BLDR-1, 120 and BLDR-2, 130, controlled by control signals, such as signals 125 and 135, generated by Multi-Bleeder Mode Control Integrated Circuit (IC) module 150. As discussed in greater detail below, Multi-Bleeder Mode Control IC module 150 may be configured to selectively activate and deactivate the multiple bleeder circuits to adjust the current conducted through closed-loop or open-loop controlled bleeder circuits BLDR-1, 120 and BLDR-2, 130 based on the operation state of the LED driver as determined based on the input sense signals 122 and Dim sense signals 134 (e.g., bleeder current and return current sense signals). Multi-Bleeder Mode Control IC module 150 may be referenced to the input ground 101 at terminal 121. It should be appreciated that, in some examples, the Multi-Bleeder Mode Control IC module 150 may be coupled to receive additional signals, such as signals 132, for performing additional features to optimize the performance of the LED driver. However, for the purpose of simplicity, such features have been omitted from the present disclosure. Moreover, input circuitry 138 may include other circuit blocks, such as input sense/detect circuitry, an inductive and capacitive filter, a damper, and any number of additional passive/active bleeders with closed-loop or open-loop control depending on the application.

Regulated converter 140 may be coupled to the output of input circuitry 138 and may be configured to generate a regulated output that, after passing through output circuitry 160 (which may include rectification and filter circuitry) and across output bulk capacitor 168 (which may be used to reduce current ripple through load 175), may include output voltage $V_O$ 170 and/or output current $I_O$ 171. As shown, regulated converter 140 may include a power switch 151 coupled to an energy transfer element 145. In one example, power switch 151 may include a metal oxide semiconductor field effect transistor (MOSFET) and energy transfer element 145 may include a coupled inductor. In these examples, regulated converter 140 may include a controller 155 coupled to control the switching of power switch 151 through a control signal 153 between an ON state (e.g., a state in which current is allowed to conduct) and an OFF state (e.g., a state in which current conduction is prevented) to control the amount of energy transferred from the input to the output of power converter 140 through the coupled inductor of energy transfer element 145. Controller 155 may control switching of power switch 151 based on sensed signals, such as current sense signal $I_D$ 154 and other feedback or feed forward signals 156 representative of the output or input of LED driver system 100.

It should be appreciated that regulated converter 140 may be an isolated (through energy transfer element 145) or non-isolated converter with an output ground 191 that is the same as or different than (e.g., shifted) input ground 101. Non-limiting examples of isolated converters include Flyback and forward converters, and non-limiting examples of non-isolated converters include non-isolated Buck-Boost converters, Buck converters, and Tapped Buck converters with a switch and/or an inductor on the return line that may result in an output ground 191 that is level-shifted from the input ground 101.

Figure 2A:
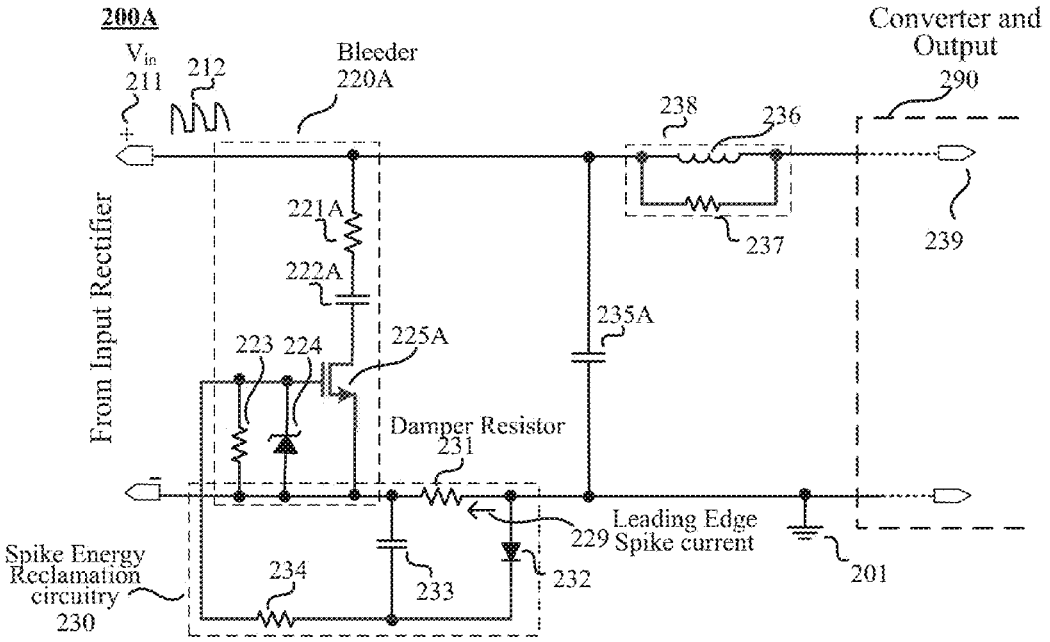
FIG. 2A (PRIOR ART)
FIG. 2A is a schematic illustrating a conventional input bleeder activated by damper spike energy reclamation circuitry.
Figure 2B:
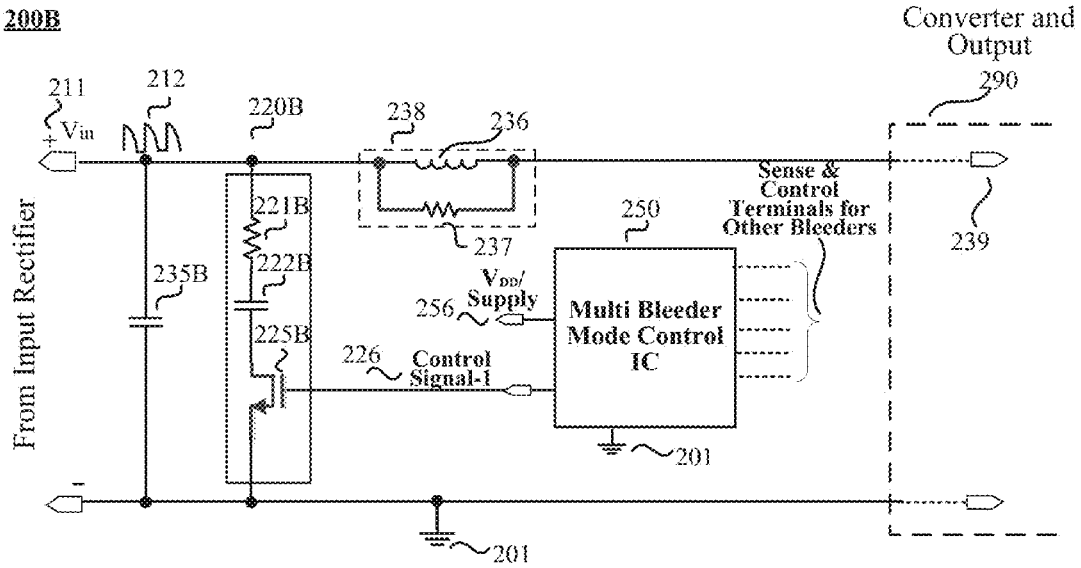
FIG. 2B is a schematic illustrating an example RC bleeder activated by a controller with multi-bleeder mode control according to various examples.

FIGS. 2A and 2B illustrate the difference in operation between a bleeder circuit activated by an analog signal response and one activated by an IC controller. Specifically, FIG. 2A illustrates an example input circuitry 200A having a conventional input bleeder 220A activated by damper spike energy reclamation circuitry 230, which is described in greater detail in Applicants' pending U.S. Provisional Patent Application 61/898,883. As shown, input bleeder 220A may be coupled to receive rectified voltage $V_{in}$ 211 (represented by symbolic waveform 212), which may correspond to phase-controlled rectified input voltage $V_{in}$ 111. Input bleeder 220A may be further coupled to ground 201 and input terminals 239 of converter and output portion 290, which may correspond to converter and output portion 190 of LED driver system 100, through optional capacitive filter 235A and inductive filter 238 (having inductor L, 236 and resistor R, 237). Input bleeder 220A may include resistor 221A and capacitor 222A coupled to switch 225A. Switch 225A may be activated through damper resistor 231 via spike energy reclamation. In particular, the leading edge spike current 229 through damper resistor 231 may generate a pulse voltage that charges capacitor 233 through diode 232 and the integrated voltage across capacitor 233 at each switching cycle may be applied to the gate of active bleeder switch 225A through divider resistors 234 and 223. Input bleeder 220A may further include Zener component 224 for providing overshoot protection to prevent damage to the gate of switch 225A due to possible over-voltages.

FIG. 2B illustrates an example input circuitry 200B that may be used to implement input circuitry 138 and that includes an active RC bleeder 220B according to various examples. RC bleeder 220B may be coupled to receive rectified voltage $V_{in}$ 211 (represented by symbolic waveform 212) across capacitive filter 235B. RC bleeder 220B may be further coupled to ground 201 and input terminals 239 of converter and output portion 290, which may correspond to converter and output portion 190 of LED driver system 100, through inductive filter 238 (having inductor L, 236 and resistor R, 237). RC bleeder 220B may include resistor 221B, capacitor 222B, and bleeder active switch 225B, which may be controlled by control signal 226 from Multi-Bleeder Mode Control IC module 250. Multi-Bleeder Mode Control IC module 250 may be coupled to receive $V_{DD}$/Supply 256 and may be referenced to primary ground 201. While only one bleeder circuit is shown, it should be appreciated that input circuitry 200B may include any number of open-loop or closed-loop controlled bleeder circuits and that Multi-Bleeder Mode Control IC module 250 may include additional sense and control terminals to control these additional bleeders. In contrast to input bleeder 220A (in FIG. 2A) in which switch 225A is activated by an analog signal response of the spike energy reclamation circuitry 230, switch 225B of bleeder 220B (in FIG. 2B) is activated in response to a control signal from the controller 250 (e.g., generated based on a preprogrammed algorithm).

Figure 3:
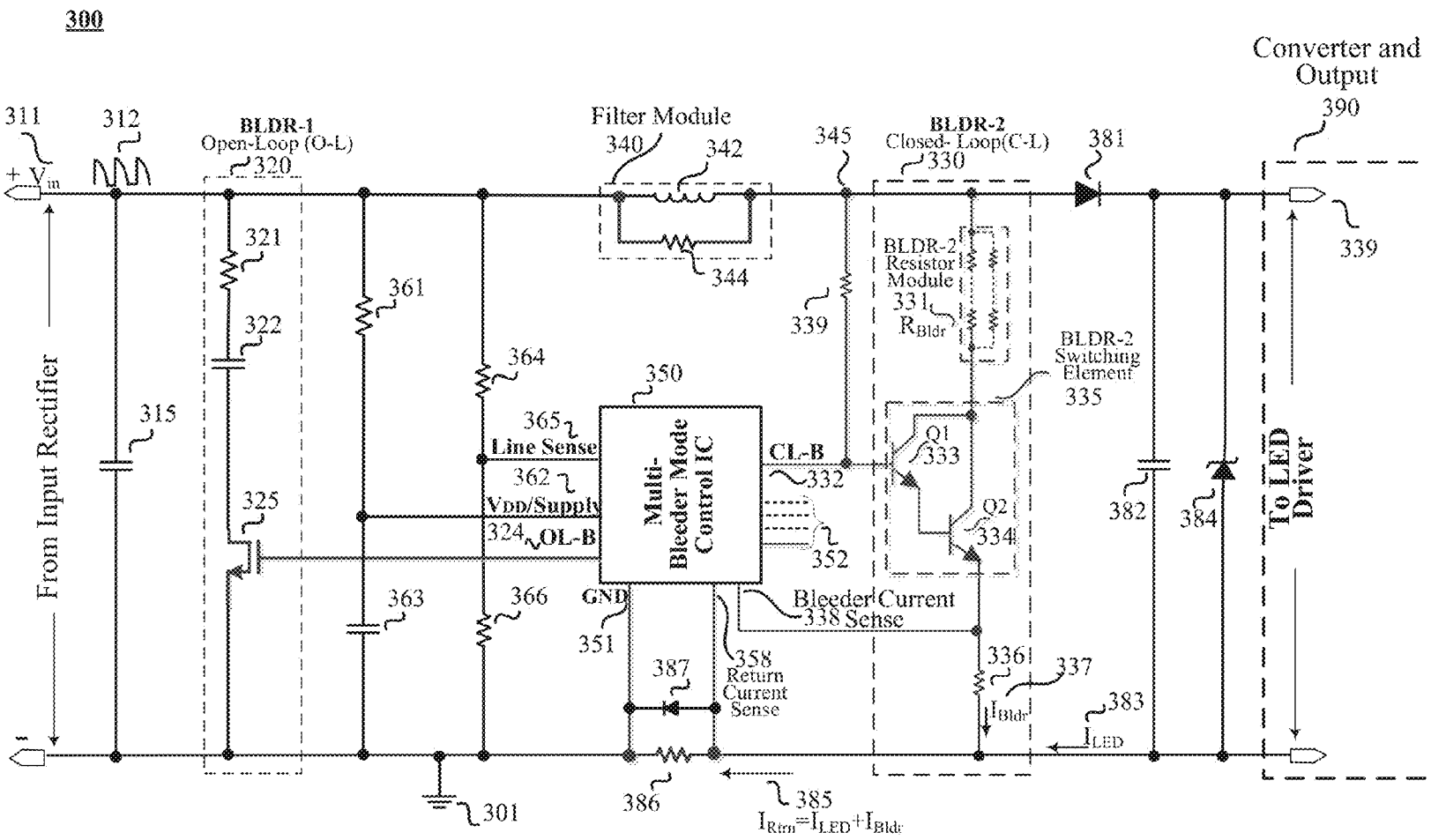
FIG. 3 is a detailed circuit diagram illustrating a controller with multi-bleeder mode control that implements open and/or closed-loop control of multiple bleeder switching elements at the input of an LED driver according to various examples.

FIG. 3 is a detailed circuit diagram illustrating example input circuitry 300 that may be used to implement input circuitry 138 or 200B. The input terminals of input circuitry 300 may be coupled to receive the phase-controlled rectified input voltage $V_{in}$ 311 (represented by symbolic waveform 312), which may correspond to phase-controlled rectified input voltage $V_{in}$ 111 from bridge rectifier 108. Input circuitry 300 may further include input capacitor 315 coupled between the input terminals of input circuitry 300 and output capacitor 382 coupled across terminals 339 for filtering noise in phase-controlled rectified input voltage $V_{in}$ 311. Input circuitry 300 may further include diode 381 for preventing return current from being conducted from converter and output portion 390 (which may correspond to converter and output portion 190) towards the input of input circuitry 300. Input circuitry 300 may further include Zener component 384 having one or more Zener diodes coupled across output capacitor 382 to clamp the voltage at a certain level to prevent damage to the components of input circuitry 300. Input circuitry 300 may further include optional filter module 340 having inductor 342 and resistor 344 to act as a differential mode noise filter that may improve performance of the LED driver.

Input circuitry 300 may further include Multi-Bleeder Mode Control IC module 350 having a $V_{DD}$/supply terminal 362 coupled to receive a $V_{DD}$ supply that, in one example, may be provided by an RC circuit having resistor R, 361 and capacitor C, 363 coupled between ground 301 and the input rail of the phase-controlled rectified input voltage $V_{in}$ 311. Multi-Bleeder Mode Control IC module 350 may be used to implement Multi-Bleeder Mode Control IC module 150 or Multi-Bleeder Mode Control IC module 250 and may further include a line sense terminal 365 coupled to receive a sense signal representative of phase-controlled rectified input voltage $V_{in}$ 311 (e.g., the instantaneous values for dimmer edge detections) through a resistive divider having resistors 364 and 366.

Multi-Bleeder Mode Control IC module 350 may be configured to generate any number of desired open-loop and closed-loop activation signals to control multiple bleeders based on the state of operation of the LED driver. For example, FIG. 3 illustrates input circuitry 300 for an LED driver having first bleeder BLDR-1, 320 with open-loop control and a second bleeder BLDR-2, 330 with closed-loop control. First bleeder BLDR-1, 320 includes resistor R 321, capacitor C, 322, and switch 325, and second bleeder BLDR-2, 330 includes resistor module $R_{Bldr}$, 331 having any number of parallel and/or series coupled resistors, switching element 335, and sense resistor 336. In one example, switching element 335 may include a Darlington pair of transistors Q1, 333 and Q2, 334.

In one example, when switching element 335 of second bleeder BLDR-2, 330 is operating in a closed-loop control to control sinking and/or sourcing current through second bleeder BLDR-2, 330, it may operate in either a linear mode control or a pulse width modulation (PWM) control.

When switching element 335 of second bleeder BLDR-2, 330 is in an active mode by having its control terminal pulled up to the high line potential of node 345 through the pull-up resistor 339, the activation current to the control terminal of switching element 335 of second bleeder BLDR-2, 330 may be controlled by the controller sinking a current through the internal circuitry at terminal 332. Thus, multi-bleeder mode control IC module 350 linearly controls the activation current to the control terminal of switching element 335 (e.g., the base of transistor Q1, 333, which defines the base current of second transistor Q2 334 of the Darlington pair of transistors of switching element 335). Consequently, switching element 335 may conduct in a linear conduction mode (from an extent of fully ON state to an extent of fully OFF state). In a linear conduction mode, the current through second bleeder BLDR-2, 330 is linearly controlled in a closed-loop in response to bleeder current $I_{Bldr}$ 337 and the return line current $I_{Rtrn}$ 385.

In other examples, switching element 335 of second bleeder BLDR-2, 330 may operate in closed-loop PWM control mode to control sinking and/or sourcing current through second bleeder BLDR-2, 330 during each half-line cycle of the phase controlled input voltage. In a PWM closed-loop control of the second bleeder BLDR-2, 330 the control terminal of switching element 335 may be either pulled up to high line potential of node 345 (through the pull-up resistor 339) to turn the switching element 335 to an ON state or may be pulled down to ground through the internal circuitry of the controller at terminal 332 of multi-bleeder mode control IC module 350 to turn it to an OFF state for a PWM closed-loop current control in second bleeder BLDR-2, 330.

When the base of transistor Q1, 333 is pulled-up through resistor 339, transistor Q1, 333 and switching element 335 remain activated and sink a bleeder current $I_{Bldr}$ 337 through bleeder current sense resistor 336. Sense resistor 336 may be used to provide a bleeder current sense signal representing the current $I_{Bldr}$ 337 conducted through second bleeder BLDR-2, 330 to terminal 338 of Multi-Bleeder Mode Control IC module 350. Multi-Bleeder Mode Control IC module 350 may be configured to selectively activate and deactivate the first and second bleeders by outputting open-loop control signal OL-B at terminal 324 and closed-loop control signal CL-B at terminal 332 to control switch 325 of the first bleeder BLDR-1, 320 and switching element 335 of the second bleeder BLDR-2, 330. Additionally, since second bleeder BLDR-2, 330 is a closed-loop controlled bleeder, Multi-Bleeder Mode Control IC module 350 may adjust the amount of current sinked through second bleeder BLDR-2, 330 based on a sensed parameter of the system, such as the load or current drawn by the load. For example, Multi-Bleeder Mode Control IC module 350 may increase the bleeder current $I_{Bldr}$ 337 sinked through second bleeder BLDR-2, 330 in response to a decrease in the load or current drawn by the load, and may decrease the bleeder current $I_{Bldr}$ 337 sinked through second bleeder BLDR-2, 330 in response to an increase in the load or current drawn by the load.

Input circuitry 300 may further include return line current sense resistor 386 for providing a return line current sense signal representing the return line current 385 to terminal 358 of Multi-Bleeder Mode Control IC module 350. The return current line sense signal received at terminal 358 may be processed by Multi-Bleeder Mode Control IC module 350 along with the line sense signal received at terminal 365 to selectively activate or deactivate the first and second bleeders.

Resistor 386 may be positioned at a location on the return line to sense return line current $I_{Rtrn}$ 385, which is summation of LED load return current $I_{LED}$ 383 and second bleeder current $I_{Bldr}$ 337, to allow Multi-Bleeder Mode Control IC module 350 to control return line current $I_{Rtrn}$ 385 and to keep it above a certain threshold. It is appreciated that in different examples of control configurations (either for non-PFC or PFC controllers with sinusoidal variations of line return current), positioning resistor 386 in this location to sense and control the return line current $I_{Rtrn}$ 385 (e.g., a summation of LED load return current $I_{LED}$ 383 and second bleeder current $I_{Bldr}$ 337) to keep it above the Triac holding current threshold advantageously results in minimizing second bleeder current $I_{Bldr}$ 337 and the possible power dissipation in the closed-loop control of second bleeder BLDR-2, 330 to reduce excess heat generated in resistor module $R_{Bldr}$, 331.

Input circuitry 300 may further include diode 387 coupled across resistor 386 to limit the voltage on terminal 358 with reference to ground terminal GND 351. The voltage drop across resistor 386 may be limited to the diode forward voltage drop of about 0.7 V.

It should be appreciated that, in some examples, Multi-Bleeder Mode Control IC module 350 may include additional terminals 352 for receiving and outputting additional sense and control signals for performing other features to optimize the performance of the LED driver or to control additional bleeder circuits. However, for the purpose of simplicity, such features have been omitted from the present disclosure.

Figure 4:
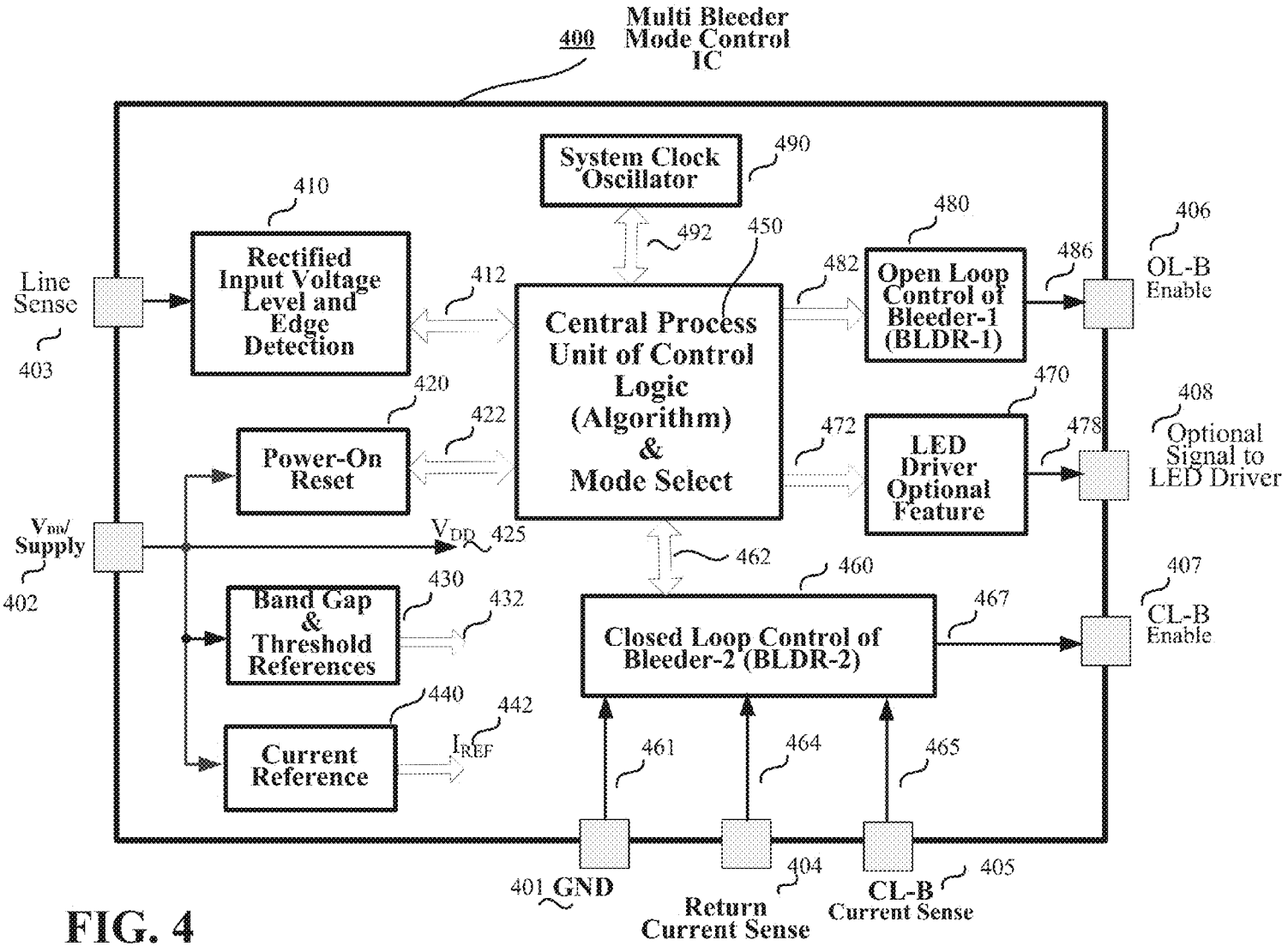
FIG. 4 is block diagram of a controller with multi-bleeder mode control according to various examples.

FIG. 4 shows an internal block diagram of an example Multi-Bleeder Mode Control IC module 400 that may be used to implement Multi-Bleeder Mode Control IC module 150, 250, or 350. Multi-Bleeder Mode Control IC module 400 may include input voltage sense terminal 403 coupled to receive a line sense signal that is representative of a phase-controlled rectified input voltage (e.g., $V_{in}$ 111, 211, or 311 shown in FIGS. 1, 2A/B, and 3, respectively). In one example, the line sense signal may be received from a resistor divider (e.g., resistors 364 and 366) coupled to the phase-controlled rectified voltage. In other examples, the line sense signal may be received or determined from the line current (e.g., by using a resistor inserted on the return path of the input line). Multi-Bleeder Mode Control IC module 400 may further include Rectified Input Voltage Level and Edge Detection block 410 coupled to receive the line sense signal from terminal 403 and configured to process the line sense signal to detect a voltage level of the line sense signal and/or a leading or trailing edge in the line sense signal. Block 410 may communicate the detected level and/or detected leading or trailing edges with Central Process Unit of Control Logic/Algorithm & Mode Select block 450 via communication signal line 412, which may be a digital or analog signal. Central Process Unit of Control Logic/Algorithm & Mode Select block 450 may act as the central processing unit (CPU) of Multi-Bleeder Mode Control IC module 400 and, in some examples, may include a digital processing ASIC unit.

Multi-Bleeder Mode Control IC module 400 may further include $V_{DD}$ supply terminal 402 coupled to receive supply voltage that, in one example, may be received from an RC circuit (e.g., resistor R, 361 and capacitor C, 363). Terminal 402 may be internally coupled to provide a bias voltage to multiple controller blocks, such as Power-on Reset block 420 that communicates with Central Process Unit of Control Logic/Algorithm & Mode Select block 450 via communication signal line 422 to provide detection signals of the instantaneous input voltage value for the leading-edge or trailing-edge phase control dimming. Terminal 402 may be further coupled to provide a bias voltage to Band Gap and Threshold References block 430, which may provide signal 432 that include band gap and threshold reference voltage signals used in different blocks of Multi-Bleeder Mode Control IC module 400 for the threshold detection of sensed or processed parameters. Terminal 402 may be further coupled to provide a bias voltage to Current Reference block 440, which may generate reference current signals $I_{REF}$ 442 that may be used in different blocks of Multi-Bleeder Mode Control IC module 400 for the threshold detection of sensed or processed parameters. Terminal 402 may be further coupled to provide voltage $V_{DD}$ 425 to other internal circuitries requiring a bias voltage.

Multi-Bleeder Mode Control IC module 400 may further include Open-loop control of Bleeder-1 block 480 configured to provide open-loop control signal 486 at OL-B Enable terminal 406 (e.g., terminal 324 in FIG. 3) for controlling the switching element of the first bleeder (e.g., switch 325 of the first bleeder BLDR-1, 320). Open-loop control of Bleeder-1 block 480 may generate control signal 486 based on the communication signals 482 from Central Process Unit of Control Logic/Algorithm & Mode Select block 450, which may be pre-programmed signals generated based on the operational state of the LED driver (e.g., startup/power up mode, no dimming mode, or leading-edge or trailing-edge dimming).

Multi-Bleeder Mode Control IC module 400 may further include Closed-loop control of Bleeder-2 block 460 configured to provide switching enable signal 467 at CL-B Enable terminal 407 (e.g., terminal 332 in FIG. 3) for controlling the switching element of the second bleeder (e.g., switching element 335 of second bleeder BLDR-2, 330). Closed-loop control of Bleeder-2 block 460 may generate switching enable signal 467 using a closed-loop process based on bleeder current sense signal 465 received from terminal 405 (e.g., the current sense signal received at terminal 338) and return current sense 464 received from terminal 404 (e.g., the return current sense signal received at terminal 358), which are referenced to the primary ground reference signal 461 received at terminal 401 (e.g., ground 301 coupled to terminal 351). Closed-loop control of Bleeder-2 block 460 may process the received signals (e.g., signals 464 and 465) and communicate with Central Process Unit of Control Logic/Algorithm & Mode Select block 450 via communication signals 462 to enable or disable the switching element of the second bleeder based on the input voltage, dimming status, and dimming type of the LED driver.

Multi-Bleeder Mode Control IC module 400 may further include System Clock Oscillator block 490 coupled to provide Central Process Unit of Control Logic/Algorithm & Mode Select block 450 with timing sequence signals 492 that may be used by some or all of the internal blocks of Multi-Bleeder Mode Control IC module 400.

It should be appreciated that some of the controller terminals in FIG. 4 may be multi-function terminals and that Multi-Bleeder Mode Control IC module 400 may be configured to implement additional features to optimize the performance of the LED driver (which, for the purpose of simplicity, have been omitted from the present disclosure). For example, Multi-Bleeder Mode Control IC module 400 may further include one or more Optional signals to LED Driver terminals 408 for outputting additional control signals 478 to implement the additional features. These additional control signals 478 may be generated by LED Driver Optional Feature block 470 based on communication signals 472 from Central Process Unit of Control Logic/Algorithm & Mode Select block 450. Additionally, it should be appreciated that Multi-Bleeder Mode Control IC module 400 may include additional blocks and sense/control terminals for controlling additional open-loop or closed-loop controlled bleeder circuits.

Figure 5:
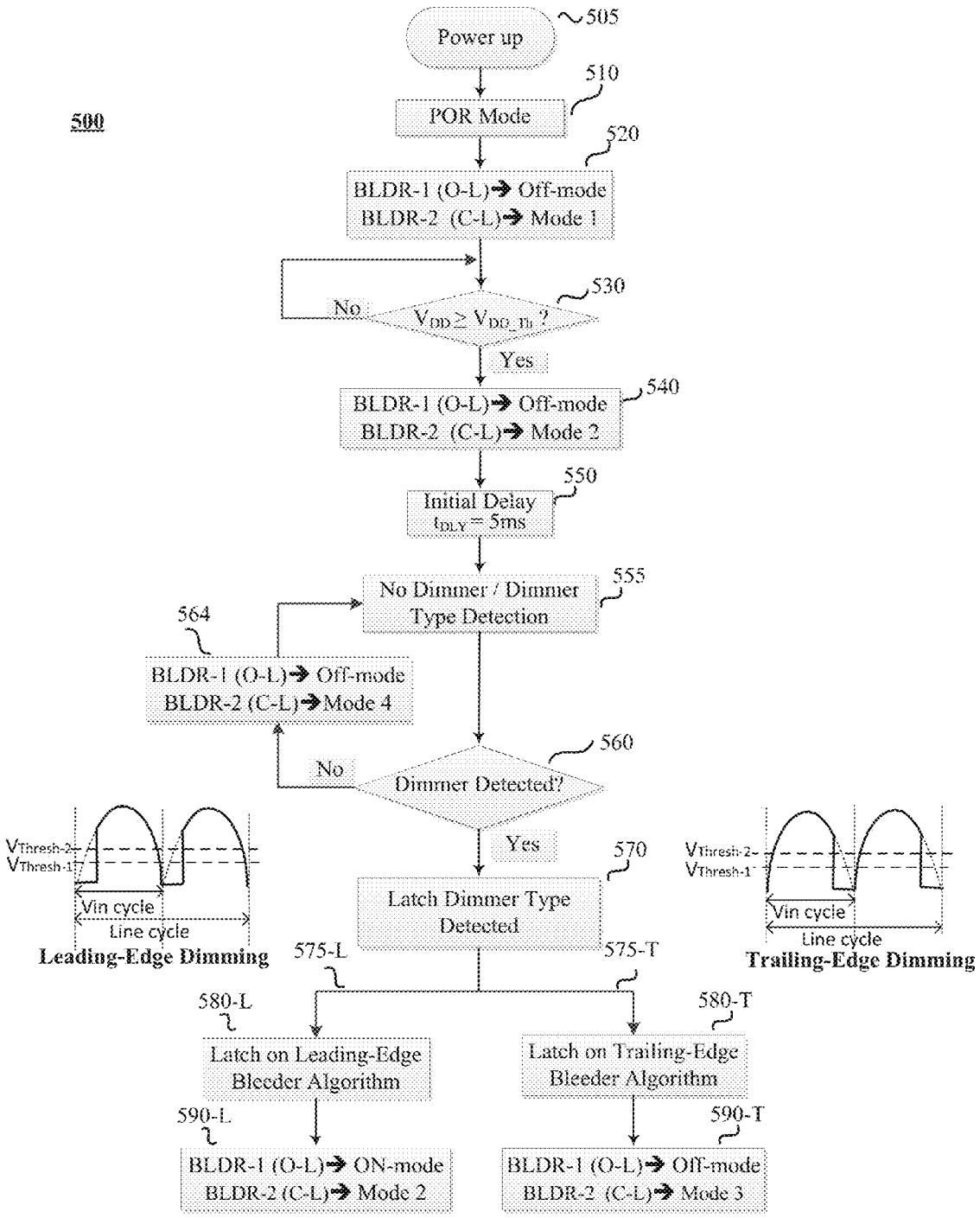
FIG. 5 is a flow chart illustrating an example process for a controller with multi-bleeder mode control at no dimming, leading-edge dimming, and trailing-edge dimming operation.

FIG. 5 is a flow chart illustrating an example process 500 that may be performed by a controller (e.g., 150, 250, 350, or 400) to implement multi-bleeder mode control for an LED driver. At block 505, the LED driver and the multi-bleeder mode controller may power up. At block 510, the multi-bleeder mode controller may enter a power on mode (POR).

At block 520, in some examples using two bleeders (e.g., those shown in FIGS. 1, 3, and 4), the controller may cause the first bleeder BLDR-1 (e.g., bleeder 120 or 320) with an open loop (O-L) control to enter an OFF state by outputting a control signal that causes the switch (e.g., switch 325) of the first bleeder BLDR-1 to be in an OFF state. Additionally, at block 520, the controller may cause the second bleeder BLDR-2 with a closed loop (C-L) control (e.g., bleeder 130 or 330) to operate in a first mode. In this first mode, the controller may cause the switching element (e.g., switching element 335) of the second bleeder BLDR-2 to be in an ON state (e.g., by allowing terminal 332 to be pulled up to the high line potential of node 345 through the pull-up resistor 339, resulting in the control terminal of switching element 335 also being latched to logic high) for the entire cycle of the phase-controlled rectified input voltage $V_{in}$. In this first mode, the bleeder current $I_{Bldr}$ (e.g., $I_{Bldr}$ 337) through the second bleeder BLDR-2 may have a value of $V_{in}/(R_{BLDR}+R_{SENSE})$, where $R_{SENSE}$ is the resistance of the sense resistor (e.g., sense resistor 336) for the current $I_{Bldr}$ through the second bleeder BLDR-2. In one example, the value of $R_{SENSE}$ may be relatively small compared to the resistance of $R_{BLDR}$. Thus, in these examples, the bleeder current $I_{Bldr}$ may be approximated as $V_{in}/R_{BLDR}$.

At block 530, it may be determined whether the supply voltage $V_{DD}$ (e.g., the voltage at terminal 362 or 402) of the controller has reached a threshold value $V_{DD_th}$ ($V_{DD} \geq V_{DD_th}$) representing a voltage for full operation of the controller. If, at block 530, it is determined that the supply voltage $V_{DD}$ has not yet reached the full operation level $V_{DD_th}$, then the first bleeder BLDR-1 and second bleeder BLDR-2 may continue to be operated as specified by block 520 while block 530 of process 500 may be repeated until it is determined that the supply voltage $V_{DD}$ is equal to or greater than the threshold value $V_{DD_th}$. Once it is determined at block 530 that the supply voltage $V_{DD}$ is equal to or greater than threshold value $V_{DD_th}$, process 500 may proceed to block 540 followed by an optional initial delay $T_{DLY}$ (e.g., of about 5 ms) at block 550.

At block 540, the controller may cause the first bleeder BLDR-1 to remain in the OFF state by outputting a control signal that causes the switch of the first bleeder BLDR-1 to remain in the OFF state. Additionally, at block 540, the controller may cause the second bleeder BLDR-2 to operate in a second mode. In the second mode, the controller may cause the second bleeder BLDR-2 to remain in an ON state by allowing the switching element of the second bleeder BLDR-2 to be in an ON state (e.g., by allowing terminal 332 to be pulled up to the high line potential of node 345 through the pull up resistor 339, resulting in the control terminal of switching element 335 also being latched to logic high). The controller may keep the second bleeder BLDR-2 in the ON state in each cycle of the phase-controlled rectified input voltage $V_{in}$ until either leading-edge dimming is detected (e.g., determined by block 410 in FIG. 4) or phase-controlled rectified input voltage $V_{in}$ exceeds a second threshold voltage $V_{Thresh2}$ (e.g., as determined by block 410 in FIG. 4). In response to determining that leading-edge dimming is being performed or that phase-controlled rectified input voltage $V_{in}$ has increased to a value greater than the second threshold $V_{Thresh2}$, the controller may transition, after a short delay (e.g., about 100 us), the operation of the second bleeder BLDR-2 to a closed-loop control in which the bleeder current $I_{Bldr}$ of the second bleeder BLDR-2 based on a sensed parameter of the system, such as the load or current drawn by the load (e.g., the return current sense signal $I_{Rtrn}$ 385). For example, the controller may cause the bleeder current $I_{Bldr}$ sinked through second bleeder BLDR-2 to increase in response to a decrease in the return current sense signal $I_{Rtrn}$, and may cause the bleeder current $I_{Bldr}$ sinked through second bleeder BLDR-2 to decrease in response to an increase in the return current sense signal $I_{Rtrn}$. The controller may operate the second bleeder BLDR-2 in a closed-loop in response to the return current sense signal $I_{Rtrn}$ until the phase-controlled rectified input voltage $V_{in}$ decreases below a first voltage threshold $V_{Thresh1}$ (where $V_{Thresh1}<V_{Thresh2}$). The controller may then cause the second bleeder BLDR-2 to remain in the ON state until the next cycle of the phase-controlled rectified input voltage $V_{in}$ when the operation of the second mode may be repeated. After the optional initial delay $T_{DLY}$ (e.g., of about 5 ms) at block 550, the process may proceed to block 555.

At block 555, dimming detection may be performed to determine whether dimming is being applied to the phase-controlled rectified input voltage $V_{in}$ and to determine the type of dimming being applied. At block 560, if it has been determined that no dimming is being applied to phase-controlled rectified input voltage $V_{in}$, the process may proceed to block 564 where the controller may cause the first bleeder to remain in the OFF state by outputting a control signal that causes the switch of the first bleeder BLDR-1 to remain in the OFF state. Additionally, at block 564, the controller may operate the second bleeder BLDR-2 in a fourth mode of operation. In the fourth mode of operation, the controller may cause the second bleeder BLDR-2 to be in the OFF state for the entire cycle of phase-controlled rectified input voltage $V_{in}$ by pulling down the voltage at the output terminal (e.g., terminal 332 or 407) of the controller that is coupled to the control terminal of the switching element. As a result, the current from the high line potential node (e.g., node 345) may conduct through a pull-up resistor (e.g., resistor 339) to ground, thereby preventing the switching element (e.g., switching element 335) from entering the ON state. Blocks 555, 560, and 564 may continue to be performed until it is determined that dimming is being performed at block 560.

Once it is determined at block 560 that dimming is being performed, the process may proceed to block 570. At block 570, the detected dimmer type may be latched or fixed for the remainder of process 500 until an LED driver reset operation is performed, causing the process to return to block 505 where the LED driver and controller are again powered-up.

Process 500 may then proceed to either the left side (575-L) or right side (575-T) of the flow chart based on whether leading-edge or trailing-edge dimming has been detected. If leading-edge dimming has been detected (represented by the symbolic waveform on the left side of FIG. 5), process 500 may proceed to block 580-L where the process may be latched or fixed on the Leading-Edge Bleeder algorithm of block 590-L. At block 590-L, the controller may cause the first bleeder BLDR-1 to be in the ON state with an open loop (O-L) control by outputting a control signal causing the switch of the first bleeder BLDR-1 to be in the ON state. Additionally, at block 590-L, the controller may operate the second bleeder BLDR-2 in the second mode of operation, discussed above.

If, however, trailing-edge dimming has been detected (represented by the symbolic waveform on the right side of FIG. 5), process 500 may instead proceed to block 580-T, where the process may be latched on the Trailing-Edge Bleeder algorithm of block 590-T. At block 590-T, the controller may cause the first bleeder BLDR-1 with an open loop (O-L) control to be in the OFF state by outputting a control signal that causes the switch of the first bleeder BLDR-1 to be in the OFF state. Additionally, at block 590-T, the controller may operate the second bleeder BLDR-2 with a closed loop (C-L) control in a third mode of operation. In the third mode of operation, the controller may force the second bleeder BLDR-2 into the OFF state at the zero crossing of the phase-controlled rectified input voltage $V_{in}$ by pulling down the voltage at the output terminal (e.g., terminal 332 or 407) of the controller that is coupled to the control terminal of the switching element 335. As a result, the current from the high line potential node (e.g., node 345) may conduct through the pull-up resistor (e.g., resistor 339) to ground inside the controller, thereby preventing the switching element (e.g., switching element 335) from entering the ON state. In response to the detection of a Tailing-Edge drop (e.g., by block 410 identifying a decrease in the phase-controlled rectified input voltage $V_{in}$ due to the phase dimming) or when the phase-controlled rectified input voltage $V_{in}$ decreases below the first threshold $V_{Thresh1}$ (e.g., as determined by block 410), the controller may cause the second bleeder BLDR-2 to be put in the ON state by releasing the pull down (to ground) of the control signal and allowing the control terminal of the switching element (e.g., 335) of the second bleeder BLDR-2 to be latched high through a pull up resistor (e.g., resistor 339). While in the ON state, the bleeder current $I_{Bldr}$ (e.g., $I_{Bldr}$ 337) through the second bleeder BLDR-2 may be approximated as $V_{in}/R_{BLDR}$, as discussed above. Once a new cycle of phase-controlled rectified input voltage $V_{in}$ begins, the operation of the third mode may be repeated by the controller causing the second bleeder BLDR-2 to be in the OFF state from the zero crossing of the phase-controlled rectified input voltage $V_{in}$ until either a Tailing-Edge drop is detected or the phase-controlled rectified input voltage $V_{in}$ decreases below the first threshold $V_{Thresh1}$.

In one example, the control of the second bleeder BLDR-2 may also be placed into the fourth mode of operation in response to a detection of an LED driver fault condition. When placed into the fourth mode of operation in response to a fault detection, the second bleeder BLDR-2 may be forced into an OFF state for the entire cycle of phase-controlled rectified input voltage $V_{in}$ by pulling down the voltage at the output terminal (e.g., terminal 332 or 407) of the controller that is coupled to the control terminal of the switching element, thereby sinking the current from the high line potential node (e.g., node 345) through a pull-up resistor (e.g., resistor 339) to ground to prevent the switching element from turning ON (closing).

The above description of illustrated examples of the present invention, including what is described in the Abstract, are not intended to be exhaustive or to be a limitation to the precise forms disclosed. While specific embodiments of, and examples for, the invention are described herein for illustrative purposes, various equivalent modifications are possible without departing from the broader spirit and scope of the present invention. Indeed, it is appreciated that the specific example voltages, currents, frequencies, power range values, times, etc., are provided for explanation purposes and that other values may also be employed in other embodiments and examples in accordance with the teachings of the present invention.

These modifications can be made to examples of the invention in light of the above detailed description. The terms used in the following claims should not be construed to limit the invention to the specific embodiments disclosed in the specification and the claims. Rather, the scope is to be determined entirely by the following claims, which are to be construed in accordance with established doctrines of claim interpretation. The present specification and figures are accordingly to be regarded as illustrative rather than restrictive.

What is claimed is:

1. A multi-bleeder circuit for a light-emitting diode (LED) driver circuit, the multi-bleeder circuit comprising:

a first bleeder circuit;

a second bleeder circuit; and a controller coupled to receive a line sense signal representative of an input voltage, a bleeder current sense signal representative of a current conducted through the second bleeder circuit, and a return current sense signal representative of a return current from a load, wherein the controller is further coupled to activate and deactivate the first and second bleeder circuits based on the line sense signal, the bleeder current sense signal, and the return current sense signal, wherein the input voltage comprises a phase-controlled rectified input voltage from a dimming circuit and a rectifier, and wherein the controller is configured to:

in response to the LED driver circuit turning on:

cause the first switching element to be in the OFF state; and operate the second bleeder circuit in a first mode of operation;

in response to a supply voltage of the controller increasing to a supply threshold value:

cause the first switching element to be in the OFF state for a delay period after the supply voltage of the controller increases to the supply threshold value; and operate the second bleeder circuit in a second mode of operation for the delay period after the supply voltage of the controller increases to the supply threshold value;

in response to determining that the dimming circuit has not performed phase-angle dimming after the delay period:

cause the first switching element to be in the OFF state; and operate the second bleeder circuit in a fourth mode of operation;

in response to determining that the dimming circuit has performed leading-edge dimming after the delay period:

cause the first switching element to be in the ON state; and operate the second bleeder circuit in the second mode of operation; and in response to determining that the dimming circuit has performed trailing-edge dimming after the delay period:

cause the first switching element to be in the OFF state; and operate the second bleeder circuit in a third mode of operation.

2. The multi-bleeder circuit of claim 1, wherein the controller is configured to control the first bleeder circuit using an open-loop control, and wherein the controller is configured to control the second bleeder circuit using a closed-loop control based on the bleeder current sense signal and the return current sense signal.

3. The multi-bleeder circuit of claim 1, wherein the return current comprises a summation of a current conducted through the load and the current conducted through the second bleeder circuit.

4. The multi-bleeder circuit of claim 1, wherein the controller is coupled to receive the return current sense signal from a return current sense resistor that is coupled to receive the return current, and wherein the return current sense signal comprises a voltage across the return current resistor.

5. The multi-bleeder circuit of claim 1, wherein the first bleeder circuit comprises an open loop control of current in the first bleeder circuit.

6. The multi-bleeder circuit of claim 5, wherein the open loop control of current in the first bleeder circuit is implemented using a first switching element, and wherein the controller is coupled to activate and deactivate the first bleeder circuit by switching the first switching element between an ON state and an OFF state.

7. The multi-bleeder circuit of claim 1, wherein the second bleeder circuit comprises a closed loop control of current in the second bleeder circuit.

8. The multi-bleeder circuit of claim 7, wherein the closed loop control of current in the second bleeder circuit is implemented using a second switching element, and wherein the controller is coupled to activate and deactivate the second bleeder circuit by sinking or sourcing current to the second switching element.

9. The multi-bleeder circuit of claim 8, wherein the closed loop control of current in the second bleeder circuit is implemented using a linear mode control of the second switching element, and wherein the controller linearly controls the activation of the second switching element to conduct in a linear mode in a closed-loop response to the bleeder current sense signal and the return current sense signal.

10. The multi-bleeder circuit of claim 8, wherein the closed-loop control of current in the second bleeder circuit is implemented using pulse width modulation (PWM) mode by switching the second switching element between an ON state and an OFF state.

11. The multi-bleeder circuit of claim 1, wherein the dimming circuit comprises a phase-controlled Triac dimming circuit.

12. The multi-bleeder circuit of claim 1, wherein in the first mode of operation the controller is configured to cause the second switching element to be latched in the ON state.

13. The multi-bleeder circuit of claim 1, wherein in the second mode of operation the controller is configured to:

cause the second switching element to be in the ON state in response to the start of a cycle of the line sense signal until it is determined that the dimming circuit has performed leading-edge dimming or it is determined that the line sense signal is greater than an upper threshold value;

in response to determining that the dimming circuit has performed leading-edge dimming or determining that the line sense signal is greater than the upper threshold value, operating the second bleeder circuit in a closed-loop based on the bleeder current sense signal and the return current sense signal until the line sense signal decreases below a lower threshold value; and in response to the line sense signal decreasing below the lower threshold value, transferring operation of the second switching element from closed-loop control to be latched in the ON state.

14. The multi-bleeder circuit of claim 1, wherein in the third mode of operation the controller is configured to:

cause the second switching element to be in the OFF state in response to a zero-crossing of the line sense signal until it is determined that a trailing-edge drop in the line sense signal has occurred or it is determined that the line sense signal is below a lower threshold value; and in response to determining that the trailing-edge drop in the line sense signal has occurred or determining that the line sense signal is below the lower threshold value, causing the second switching element to be latched in the ON state.

15. The multi-bleeder circuit of claim 1, wherein in the fourth mode of operation the controller is configured to cause the second switching element to be latched in the OFF state.

16. A light-emitting diode (LED) driver circuit comprising:

an input to be coupled to receive an alternating current (ac) input voltage;

a Triac dimming circuit coupled to the input to receive the ac input voltage and output a phase-controlled ac input voltage;

a rectifier coupled to receive the phase-controlled ac input voltage and output a phase-controlled rectified input voltage;

a power converter coupled to receive the phase-controlled rectified input voltage and output a regulated output signal to a load;

a first bleeder circuit coupled between the rectifier and the power converter;

a second bleeder circuit coupled between the rectifier and the power converter; and a controller coupled to receive a line sense signal representative of a voltage of the phase-controlled rectified input voltage, a bleeder current sense signal representative of a current conducted through the second bleeder circuit, and a return current sense signal representative of a return current from the load, wherein the controller is further coupled to activate and deactivate the first and second bleeder circuits based on the line sense signal, the bleeder current sense signal, and the return current sense signal, wherein the first bleeder circuit comprises a first switching element, and wherein the controller is coupled to activate and deactivate the first bleeder circuit by switching the first switching element between an ON state and an OFF state, wherein the second bleeder circuit comprises a second switching element, and wherein the controller is coupled to activate and deactivate the second bleeder circuit by switching the second switching element between and ON state and an OFF state, wherein the controller is configured to:

in response to the LED driver circuit turning on:

cause the first switching element to be in the OFF state; and operate the second bleeder circuit in a first mode of operation;

in response to a supply voltage of the controller increasing to a supply threshold value:

cause the first switching element to be in the OFF state for a delay period after the supply voltage of the controller increases to the supply threshold value; and operate the second bleeder circuit in a second mode of operation for the delay period after the supply voltage of the controller increases to the supply threshold value;

in response to determining that the Triac dimming circuit has not applied phase-angle dimming to the ac input voltage after the delay period:

cause the first switching element to be in the OFF state; and operate the second bleeder circuit in a fourth mode of operation;

in response to determining that the Triac dimming circuit has applied leading-edge dimming to the ac input voltage after the delay period:

cause the first switching element to be in the ON state; and operate the second bleeder circuit in the second mode of operation; and in response to determining that the Triac dimming circuit has applied trailing-edge dimming to the ac input voltage after the delay period:

cause the first switching element to be in the OFF state; and operate the second bleeder circuit in a third mode of operation.

17. The LED driver of claim 16, wherein the controller is coupled to control the first bleeder circuit using an open-loop control, and wherein the controller is coupled to control the second bleeder circuit using a closed-loop control based on the bleeder current sense signal and the return current sense signal.

18. The LED driver of claim 16, wherein the return current comprises a summation of a current conducted through the load and the current conducted through the second bleeder circuit.

19. The LED driver of claim 16, further comprising a return current sense resistor coupled to receive the return current, and wherein the return current sense signal comprises a voltage across the return current resistor.

20. The LED driver of claim 16, wherein in the first mode of operation the controller is configured to cause the second switching element to be latched in the ON state.

21. The LED driver of claim 16, wherein in the second mode of operation the controller is configured to:

cause the second switching element to be in the ON state in response to the start of a cycle of the line sense signal until it is determined that the Triac dimming circuit has applied leading-edge dimming to the ac input voltage or it is determined that the line sense signal is greater than an upper threshold value;

in response to determining that the Triac dimming circuit has applied leading-edge dimming to the ac input voltage or determining that the line sense signal is greater than the upper threshold value, operating the second bleeder circuit in a closed-loop based on the bleeder current sense signal and the return current sense signal until the line sense signal decreases below a lower threshold value; and in response to the line sense signal decreasing below the lower threshold value, transferring operation of the second switching element from closed-loop control to be latched in the ON state.

22. The LED driver of claim 16, wherein in the third mode of operation the controller is configured to:

cause the second switching element to be in the OFF state in response to a zero-crossing of the line sense signal until it is determined that a trailing-edge drop in the line sense signal has occurred or it is determined that the line sense signal is below a lower threshold value; and in response to determining that the trailing-edge drop in the line sense signal has occurred or determining that the line sense signal is below the lower threshold value, causing the second switching element to be latched in the ON state.

23. The LED driver of claim 16, wherein in the fourth mode of operation the controller is configured to cause the second switching element to be latched in the OFF state.

* * * * *